US010043438B2

(12) United States Patent
Park

(10) Patent No.: US 10,043,438 B2
(45) Date of Patent: Aug. 7, 2018

(54) DISPLAY DEVICE AND METHOD OF DRIVING THE SAME WITH PIXEL SHIFTING COMPENSATION DATA

(71) Applicant: SAMSUNG DISPLAY CO., LTD., Yongin-si, Gyeonggi-do (KR)

(72) Inventor: Jong Woong Park, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 85 days.

(21) Appl. No.: 15/187,724

(22) Filed: Jun. 20, 2016

(65) Prior Publication Data

US 2017/0154569 A1 Jun. 1, 2017

(30) Foreign Application Priority Data

Nov. 27, 2015 (KR) ..... 10-2015-0167201

(51) Int. Cl.
*G09G 3/20* (2006.01)

(52) U.S. Cl.
CPC ... *G09G 3/2096* (2013.01); *G09G 2320/0242* (2013.01)

(58) Field of Classification Search
CPC ..... G09G 3/30–3/3291; G09G 2320/0233; G09G 2320/0242; G09G 2320/04; G09G 2320/043; G09G 2320/045
See application file for complete search history.

(56) References Cited

U.S. PATENT DOCUMENTS

| | | | | |
|---|---|---|---|---|
| 7,675,492 | B2 | 3/2010 | Park et al. | |
| 8,861,848 | B2 * | 10/2014 | Sato | G06T 9/004 382/166 |
| 9,064,451 | B2 * | 6/2015 | Lynch | G06F 3/0412 |
| 9,117,400 | B2 * | 8/2015 | Chaji | G09G 3/3208 |
| 2009/0046089 | A1 * | 2/2009 | Zhuang | G09G 3/22 345/214 |
| 2013/0321361 | A1 * | 12/2013 | Lynch | G09G 3/3225 345/204 |

* cited by examiner

*Primary Examiner* — Gene W Lee
(74) *Attorney, Agent, or Firm* — Lewis Roca Rothgerber Christie LLP

(57) ABSTRACT

A display device includes a controller configured to: generate compensation data by accumulating image data; and generate the image data by reflecting the compensation data to input data received from an external source; and a display unit comprising a plurality of pixels configured to display an image according to the image data, wherein the controller generates the image data while pixel shifting the compensation data by a predetermined pixel movement amount.

14 Claims, 9 Drawing Sheets

DISPLAY DEVICE AND METHOD OF DRIVING THE SAME WITH PIXEL SHIFTING COMPENSATION DATA

CROSS-REFERENCE TO RELATED APPLICATION

This application claims priority to and the benefit of Korean Patent Application No. 10-2015-0167201, filed on Nov. 27, 2015, in the Korean Intellectual Property Office, the entire content of which is incorporated herein by reference in its entirety.

BACKGROUND

1. Field

Aspects of example embodiments of the present invention relate to a display device and a method of driving the same.

2. Description of the Related Art

Display devices are widely used for a variety of application such as for computer monitors, televisions, and mobile phones. Display devices display images, for example, by using digital data include a cathode ray tube (CRT) display device, a liquid crystal display (LCD), a plasma display panel (PDP), and an organic light emitting display device.

Among display devices, organic light emitting display devices display an image by using organic light emitting diodes (OLEDs) that generate light components by recombination of electrons and holes. Because OLED displays may obtain high color reproducibility due to a characteristic of a self-emission material and light emitting areas of pixels are reduced even in high resolution, a change in power consumption may be low or relatively negligible in the entire panel. In addition, OLED displays may have a relatively high response speed and may be driven with relatively low power consumption. In a common OLED display, driving transistors included in the respective pixels supply currents with magnitudes corresponding to data signals to OLEDs so that the OLEDs generate light.

In the pixels included in a display unit of the display device, brightness components of pixels that continuously emit light may be different from brightness components of pixels that do not emit light and then, emit light. Therefore, a shadow effect may occur. For example, a first display region of the display unit emits light and a second display region adjacent to the first display region may maintain a non-emission state for a relatively long period of time. Then, when both the first display region and the second display region are changed to be in emission states, the pixels corresponding to the first display region deteriorate so that an instantaneous latent image in which a boundary is recognized between the first display region and the second display region may be generated.

The above information disclosed in this Background section is only to enhance the understanding of the background of the disclosure, and therefore it may contain information that does not constitute prior art.

SUMMARY

Aspects of some example embodiments of the present invention relate to a method of removing a latent image in accordance with a fixed image and an apparatus therefor.

Aspects of some example embodiments of the present invention relate to a display device capable of preventing or reducing instances of a dead space from being recognized or perceived by users due to pixel shifting and preventing or reducing instances of touch information from being twisted and a method of driving the same.

Aspects of some example embodiments of the present invention relate to a display device capable of reducing a recognized latent image by releasing a latent image frame by performing compensation processing by using latent image compensation data without pixel shifting an input image and a method of driving the same.

Aspects of embodiments of the present invention are not limited to the above and other aspects that are not mentioned may be clearly understood to those skilled in the art from the following.

A display device according to some example embodiments of the present invention includes: a controller configured to: generate compensation data by accumulating image data; and generate the image data by reflecting the compensation data to input data received from an external source; and a display unit comprising a plurality of pixels configured to display an image according to the image data, wherein the controller generates the image data while pixel shifting the compensation data by a predetermined pixel movement amount.

According to some example embodiments, the controller is configured to pixel shift the compensation data by the predetermined pixel movement amount at a predetermined speed to generate the compensation data that is pixel shifted.

According to some example embodiments, the controller is configured to calculate a stress value according to a current flowing through a pixel from among the pixels and a duration time of the image data.

According to some example embodiments, the controller includes: a stress converter configured to calculate a stress value based on the image data output from each of the pixels of the display unit and to generate the compensation data according to the stress value; a pixel shifter configured to pixel shift the compensation data by a predetermined pixel movement amount and to generate pixel shifted compensation data; and a compensator configured to compensate for the image data according to the pixel shifted compensation data.

According to some example embodiments, the controller further includes a memory configured to store at least one of the stress value, the compensation data, or the pixel shifted compensation data.

According to some example embodiments, the controller is configured to pixel shift the compensation data by one pixel from a center of the display unit away from the center of the display unit to generate the image data.

According to some example embodiments, the controller is configured to pixel shift the compensation data by one pixel from a right upper end of the display unit to a left lower end of the display unit to generate the image data.

According to some example embodiments, the controller is configured to determine the predetermined pixel movement amount in a range of 0.5% and 3% of a number of simplified pixels of the display unit.

According to some example embodiments of the present invention, in a method of driving a display device, the method includes: generating compensation data by accumulating image data; and generating the image data by reflecting the compensation data to input data received from an external source, wherein the generating of the image data comprises generating the image data while pixel shifting the compensation data by a predetermined pixel movement amount.

According to some example embodiments, the generating of the image data further includes pixel shifting the compensation data by the predetermined pixel movement amount at a predetermined speed to generate pixel shifted compensation data.

According to some example embodiments, the generating of the compensation data further includes calculating a stress value according to a current flowing through a pixel from among a plurality of pixels and a duration time of the image data.

According to some example embodiments, the generating of the compensation data includes: calculating a stress value according to the image data output from each pixel of a display unit; and generating compensation data according to the stress value, and wherein the generating of the image data includes: pixel shifting the compensation data by a predetermined pixel movement amount to generate pixel shifted compensation data; and compensating for the image data according to the pixel shifted compensation data.

According to some example embodiments, the method further includes storing at least one of the stress value, the compensation data, or the pixel shifted compensation data in a memory.

According to some example embodiments, the generating of the image data comprises pixel shifting the compensation data by one pixel from a center of a display unit away from the center of the display unit to generate the image data.

According to some example embodiments, the generating of the image data comprises pixel shifting the compensation data by one pixel from a right upper end of a display unit to a left lower end of the display unit to generate the image data.

According to some example embodiments, the generating of the image data further comprises determining the predetermined pixel movement amount in a range of 0.5% and 3% of a number of simplified pixels of a display unit.

According to some example embodiments of the present invention, it may be possible to provide a method of removing a latent image in accordance with a fixed image and an apparatus therefor.

In addition, according to some example embodiments of the present invention, it may be possible to provide a display device capable of preventing or reducing instances of a dead space being recognized or perceived by users due to pixel shifting, and a method of driving the same. Furthermore, according to some example embodiments of the present invention, it may be possible to provide a display device configured to prevent or reduce instances of touch information being twisted and a method of driving the same.

In addition, according to some example embodiments of the present invention, it may be possible to provide a display device capable of reducing a recognized latent image by releasing a latent image frame by performing compensation processing by using latent image compensation data without pixel shifting an input image and a method of driving the same.

Aspects of example embodiments of the present invention are not limited to the above and other effects that are not mentioned may be clearly understood to those skilled in the art from the following.

BRIEF DESCRIPTION OF THE DRAWINGS

Aspects of some example embodiments of the present invention will now be described more fully hereinafter with reference to the accompanying drawings; however, the present invention may be embodied in different forms and should not be construed as limited to the embodiments set forth herein. Rather, these embodiments are provided so that this disclosure will be more thorough and more complete, and will more fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1A:
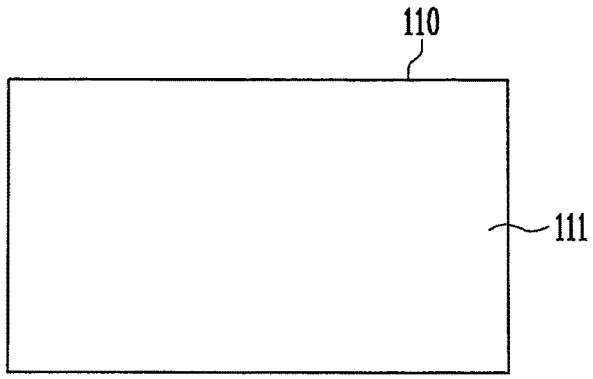
FIGS. 1A to 1E are views illustrating an example of pixel shifting.

Hereinafter, aspects of some example embodiments of the present invention will be described in more detail with reference to the accompanying drawings.

In describing the present invention, if an embodiment has been well known in the art to which the present invention pertains and technical content is not directly related to an embodiment of the present invention, some description thereof will be omitted. This is to allow the embodiment of the present invention to be more clearly understood without obscuring the embodiment of the present disclosure.

It is to be understood that when one element is referred to as being "connected to" or "coupled to" another element, it may be connected directly to or coupled directly to another element or be connected to or coupled to another element, having the other element intervening therebetween. In addition, in the following description, and the word 'including' does not preclude the presence of other components and means that an additional component is included in the technical concept of the present invention.

Terms such as 'first', 'second', etc., may be used to describe various components, but the components are not to be construed as being limited to the terms. The terms are used only to distinguish one component from another component. For example, the 'first' component may be named the 'second' component and the 'second' component may also be similarly named the 'first' component, without departing from the scope of the present invention.

Also, elements of the embodiments of the present invention are independently illustrated to show different characteristic functions, and it does not mean that each element is configured as separated hardware or a single software component. Namely, for the sake of explanation, respective elements are arranged to be included, and at least two of the respective elements may be incorporated into a single element or a single element may be divided into a plurality of elements to perform a function, and the integrated embodiment and divided embodiment of the respective elements are included in the scope of the present invention unless it diverts from the essence of the present invention.

Also, some of the elements may be optional to merely enhance the performance, rather than being essential to perform a constitutional function. Some embodiments of the present invention may be implemented by using only the elements requisite for implement the essence of the present invention, excluding elements used to merely enhance the performance, and a structure including only the essential elements excluding the optional elements merely used to enhance the performance is also included in the scope of the present invention.

In describing embodiments of the present invention, certain description of known techniques associated with the present invention may be omitted. Moreover, the terms used henceforth have been defined in consideration of the functions of the present invention, and may be altered according to the intent of a user or operator, or conventional practice. Therefore, the terms should be defined on the basis of the entire content of this specification.

FIGS. 1A to 1E are views illustrating an example of pixel shifting.

In pixels included in a display unit 110 of a display device, brightness components of pixels that continuously emit light components may be different from brightness components of pixels that do not emit light components and then, emit light components. Therefore, a shadow effect may occur. For example, a first display region of the display unit 110 emits light and a second display region adjacent to the first display region may maintain a non-emission state for a long time. Then, when both the first display region and the second display region are changed to be in emission states, the pixels corresponding to the first display region deteriorate so that an instantaneous latent image in which a boundary is recognized between the first display region and the second display region may be generated.

That is, when a specific image or character is displayed on display devices for a long time, a specific pixel of the display unit 110 may deteriorate so that a latent image may be generated.

In order to solve the above problem, a technology of moving an image 111 on the display unit 110 in a uniform period and displaying the moved image 111, for example, a pixel shifting technology may be used. When the image 111 is moved on the display unit 110 in the uniform period and the moved image 111 is displayed, it may be possible to prevent or reduce instances of the same data being output to the specific pixel for a long time and to prevent or reduce instances of the specific pixel deteriorating.

As illustrated in FIG. 1A, the image 111 may be displayed on the display unit 110. At this time, when the pixel shifting technology is directly applied to the image 111 displayed on the display unit 110, image data displayed on the outermost part of the display unit 110 is cut off so that the image 111 may be damaged.

Figure 1B:
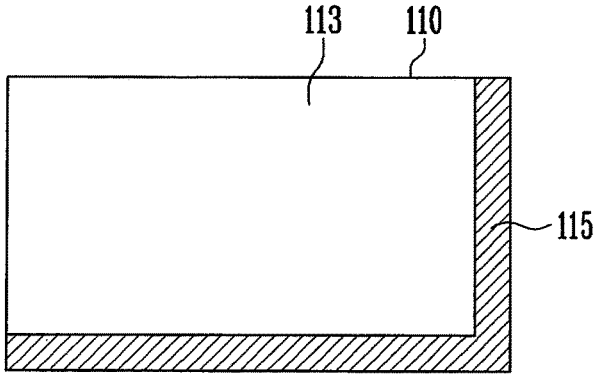

In order to prevent the image 111 from being damaged, the image 111 of the display unit 110 is downscaled as illustrated in FIG. 1B so that a corrected image 113 may be formed. For example, the downscaling may be 1% downscaling.

As illustrated in FIGS. 1B to 1E, pixel shifting in which the corrected image 113 is moved from side to side and up and down may be performed. At this time, in the pixel shifting, pixels may be moved one by one per dozens of seconds so that the pixel shifting may not be recognized or perceived by human eyes.

In addition, when the pixel shifting is performed, as illustrated in FIGS. 1B to 1E, the corrected image 113 may be biased from side to side and up and down. In this case, a dead space 115 outside the corrected image 113 may be asymmetrically generated from side to side or up and down. The dead space 115 may be recognized or perceived by the eyes of a user.

Figure 1C:
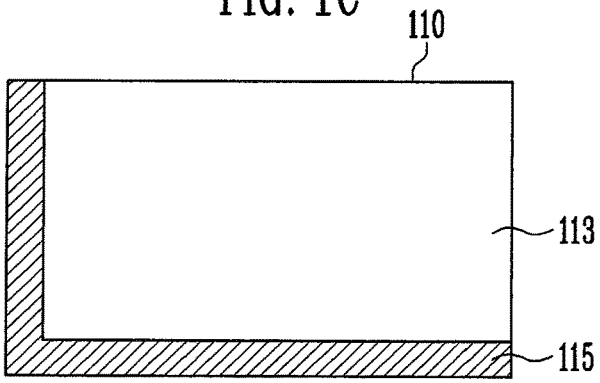
Figure 1D:
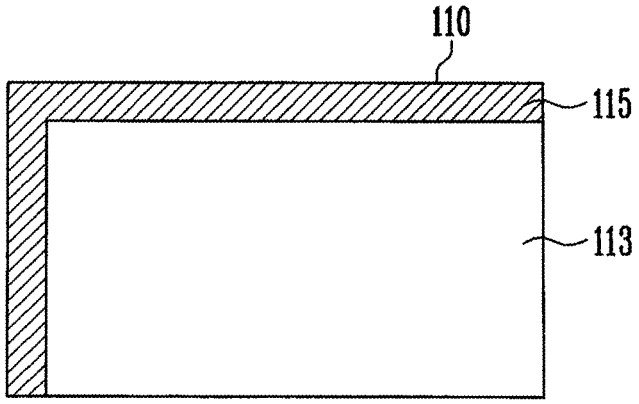
Figure 1E:
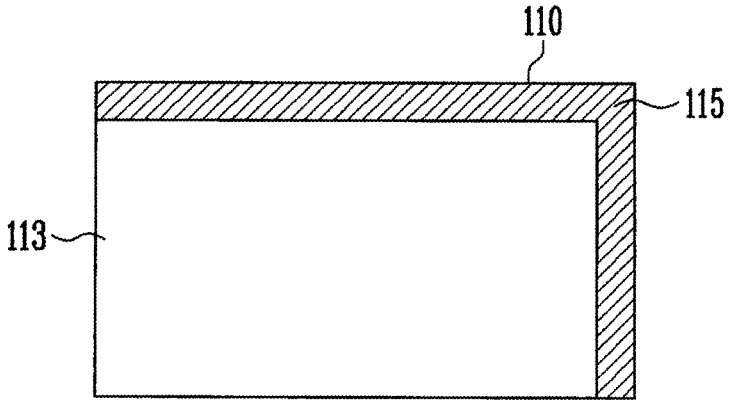

In addition, when the display unit 110 includes a touch screen, in accordance with the pixel shifting operation, a touch position may not be correctly sensed. For example, when a specific position is touched in a state in which the pixel shifting of FIG. 1C is performed, the specific position may be different from a position in the image 111 of FIG. 1A in which the pixel shifting is not performed. When the pixel shifting is performed, touch alignment may not be correctly performed. Therefore, because a correct touch position may be sensed when pixel shifting information is transmitted to a touch controller, the pixel shifting operation may become complicated.

In order to prevent or reduce instances of the dead space being recognized due to the pixel shifting and to prevent or reduce instances of touch information being twisted (e.g., misinterpreted), in the display device according to the embodiment of the present invention, an input image may not be pixel shifted but may be compensated for by using latent image compensation data so that a latent image frame is released and a recognized latent image is reduced.

Figure 2:
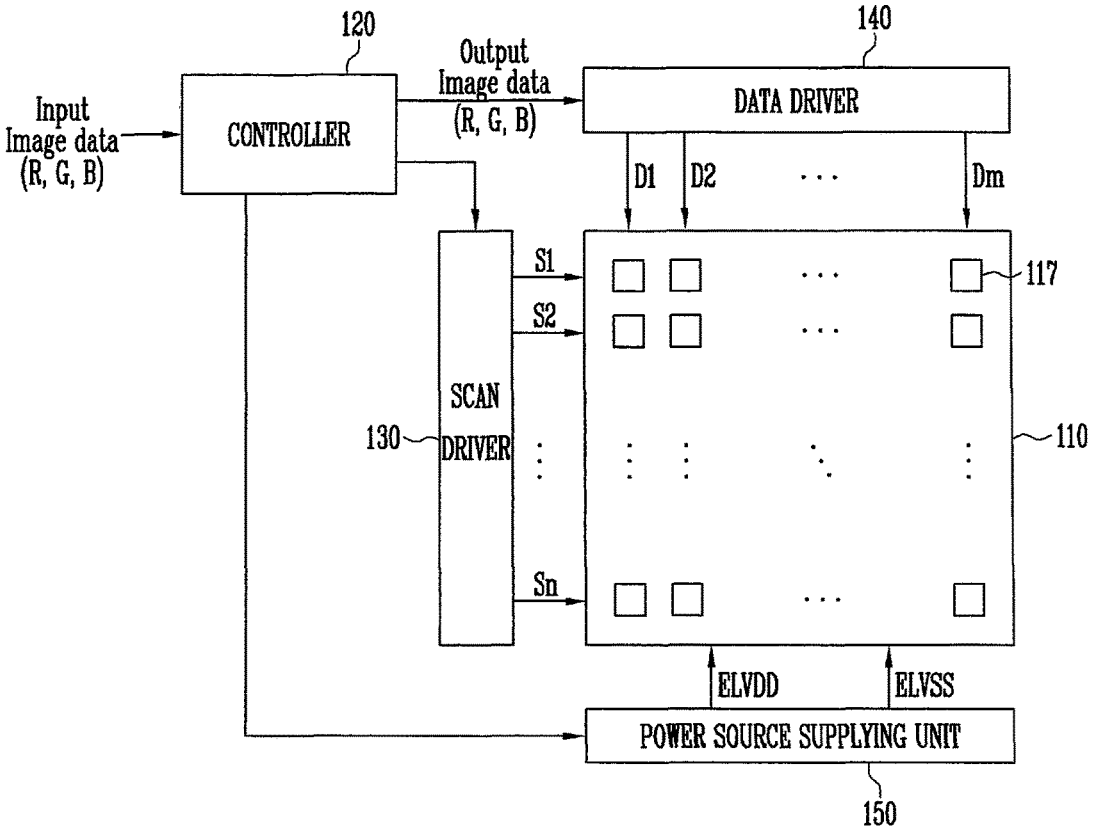
FIG. 2 is a block diagram of a display device according to some example embodiments of the present invention.
Figure 3:
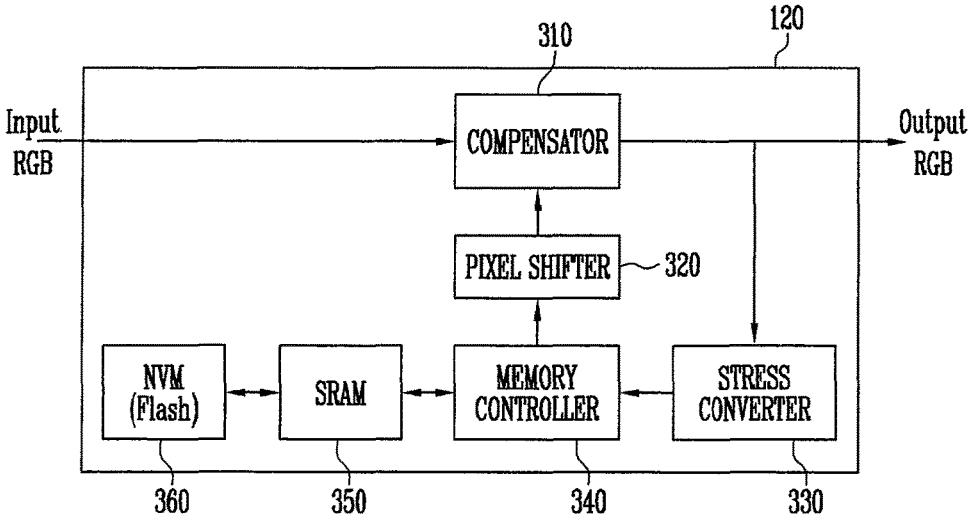
FIG. 3 is a block diagram of a controller of a display device according to some example embodiments of the present invention.
Figure 4:
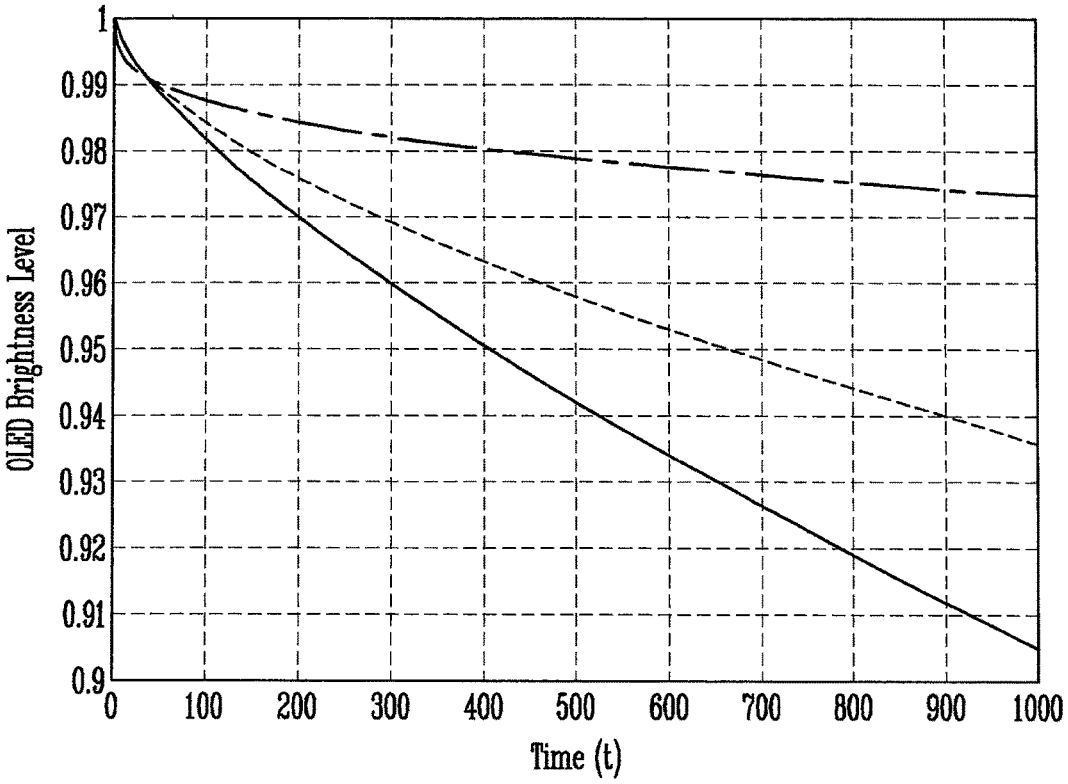
FIG. 4 is a view illustrating an example of a brightness reduction graph in accordance with stress of a display unit of a display device according to some example embodiments of the present invention.

FIG. 2 is a block diagram of a display device according to some example embodiments of the present invention. FIG. 3 is a block diagram of a controller of a display device according to some example embodiments of the present invention. FIG. 4 is a view illustrating an example of a brightness reduction graph in accordance with stress of a display unit of a display device according to some example embodiments of the present invention.

Referring to FIG. 2, the display device according to some example embodiments of the present invention may include the display unit 110 including a plurality of pixels 117, a scan driver 130 for transmitting a plurality of scan signals to the display unit 110, a data driver 140 for transmitting a plurality of data signals to the display unit 110, a power source supplying unit 150 for supplying driving voltages, for example, a first power source voltage ELVDD and a second power source voltage ELVSS to the display unit 110, and a controller 120 for controlling the scan driver 130, the data driver 140, and the power source supplying unit 150.

The display unit 110 is a panel in which the plurality of pixels 117 is arranged in a matrix. The respective pixels 117 may emit light components corresponding to flows of driving currents in accordance with the data signals transmitted from the data driver 140. At this time, the pixels 117 may include light emitting elements such as organic light emitting diodes (OLEDs). In addition, in accordance with a method of driving the OLEDs, the display device may utilize a passive matrix organic light emitting display device (PMOLED) and/or an active matrix OLED (AMOLED). At this time, according to an embodiment, the display device may be described in the context of the AMOLED, but embodiments of the present invention are not limited thereto.

A plurality of scan lines S1 to Sn formed in a row direction to transmit the scan signals from the scan driver 130 and a plurality of data lines D1 to Dm formed in a column direction to transmit the data signals from the data driver 140 are respectively arranged in the plurality of pixels 117 included in the display unit 110.

That is, among the plurality of pixels 117, the pixel 117 positioned in a jth pixel row and a kth pixel column may be connected to a corresponding scan line Sj and a corresponding data line Dk. However, embodiments of the present invention are not limited thereto. For example, the scan driver 130 may be implemented by a plurality of drivers.

Each of the pixels 117 include a pixel circuit for supplying a current in accordance with a corresponding data signal to an OLED and the OLED may emit light with a brightness (e.g., a predetermined brightness) in accordance with the supplied current. At this time, the first power source voltage ELVDD and the second power source voltage ELVSS that are required for the operation of the display unit 110 may be transmitted from the power source supplying unit 150.

The scan driver 130 for applying the plurality of scan signals to the display unit 110 are connected to the plurality of scan lines S1 to Sn and may respectively transmit the plurality of scan signals to corresponding scan lines among the plurality of scan lines S1 to Sn. The scan driver 130 generates the scan signals and may transmit the generated scan signals to the scan lines connected to the rows of the plurality of pixels 117 included in the display unit 110 in accordance with a scan driving control signal supplied from the controller 120. When the scan signals are supplied to the scan lines S1 to Sn, the pixels 117 are selected. Here, the scan driver 130 may concurrently (e.g., simultaneously) or sequentially supply the scan signals to the scan lines S1 to Sn in accordance with a driving method.

The data driver 140 generates the plurality of data signals from image data transmitted from the controller 120 and may transmit the generated data signals to the plurality of data lines D1 to Dm connected to the display unit 110. The data driver 140 may be driven by a data driving control signal supplied by the controller 120.

The controller 120 may receive a horizontal synchronizing signal, a vertical synchronizing signal, a data enable signal, and a timing signal such as a dot clock. Control signals to be respectively transmitted to the data driver 140 and the scan driver 130 may be generated by using the received signals. In addition, the controller 120 receives input image data from the outside, converts the received input image data, and may supply output image data to the data driver 140.

According to an embodiment, the scan driver 130, the data driver 140, and the controller 120 may be implemented in one display driver IC as hardware.

The plurality of pixels 117 included in the display unit 110 receive corresponding scan signals, let the OLEDs emit light components by data voltages corresponding to the data signals, and may display an image.

In addition, the display unit 110 may include a touch sensor and a touch sensing unit. When a touch event occurs by a pointer such as a finger in a specific position on the display unit 110, the touch sensor and the touch sensing unit may sense a position in which the touch event occurs.

On the other hand, according to an embodiment, as illustrated in FIG. 3, the controller 120 may include a compensator 310, a pixel shifter 320, a stress converter 330, a memory controller 340, and memories 350 and 360. According to an embodiment, the memories 350 and 360 may include a static random access memory (SRAM) 350 and a non-volatile memory (NVM) 360.

The controller 120 may receive input image data from the outside as described above. At this time, the input image data may include R, G, and B data.

The compensator 310 that receives the input image data performs compensation in accordance with a degree of deterioration of the pixels 117 on which the respective image data items are to be displayed and may output output image data. At this time, the output image data may include R, G, and B data.

At this time, the stress converter 330 may calculate a compensation value by pixel in accordance with an output image data accumulation value based on the output image data input by pixel. That is, compensation data may be calculated by pixel based on stress in accordance with an accumulation value of image data input by pixel.

In FIG. 4, an example of a brightness reduction curve in accordance with the accumulation value of the output image data input to a pixel is illustrated.

At this time, reduction in brightness in accordance with accumulation of the output image data of the pixel of FIG. 4 may be defined by the following EQUATION 1:

$$B=1-S(t_h\cdot(i/i_{std})^{Acc})^{1/T} \quad \text{[EQUATION 1]}$$

where B refers to a brightness ratio, $t_h$ refers to duration time of the output image data, i refers to a current that flows through a pixel, S and T refer to slope correction coefficients, $i_{std}$ refers to a current that becomes a reference, and Acc refers to an acceleration life coefficient.

Therefore, the stress converter 330 may accumulate a value defined by following EQUATION 2 in each frame as a stress value of each pixel based on the output image data:

$$t_h\cdot(i/i_{std})^{Acc} \quad \text{[EQUATION 2]}$$

where, i may be the yth power of the input output image data and $i_{std}$ may be the yth power (y is a positive real number) of the maximum output image data.

The stress converter 330 may calculate the compensation data in accordance with the stress value. For example, the stress converter 330 may set 1/B as a value of the compensation data. That is, when brightness reduction of 90% occurs, that is, when the B is 0.90, the stress converter 330 may calculate 1/B=1/0.90=1.111 as the value of the compensation data.

Then, the stress converter 330 transmits the value of the compensation data to the memory controller 340 and the memory controller 340 may store the value of the compensation data in the memories 350 and 360. In addition, the memory controller 340 may transmit the value of the compensation data received from the stress converter 330 or the value of the compensation data stored in the memories 350 and 360 to the pixel shifting unit 320. In addition, the pixel shifting unit 320 may transmit the pixel shifted compensation data to the memories 350 and 360 and may store the transmitted pixel shifted compensation data in the memories 350 and 360.

On the other hand, the stress converter 330 transmits the stress value accumulated in each frame to the memory controller 340 and may store the transmitted stress value in the memories 350 and 360. Then, the stress converter 330 receives the accumulated stress value from the memories 350 and 360 and may determine the compensation data by using the value.

The pixel shifting unit 320 pixel shifts the received compensation data by a pixel movement amount (e.g., a predetermined pixel movement amount) at a speed (e.g., a predetermined speed) and may transmit the value to the compensator 310. Then, the compensator 310 compensates for the input image data by using the pixel shifted compensation data and may output the compensated input image data as the output image data.

At this time, the pixel shifting speed and the pixel movement amount of the compensation data may vary in accordance with the display device and the display unit. For example, the pixel shifting of the compensation data may be set so that pixels move one by one per one minute, by twos per one minute, or one by one per 30 seconds. In addition, according to an embodiment, the pixel shifting speed and the pixel movement amount of the compensation data may change in accordance with setting of a user.

In addition, the pixel movement amount of the compensation data may vary in accordance with resolution and application of the display unit 110. For example, in the case of portable devices such as a smart phone and a tablet PC, when ±1% of the number of simplified pixels of the resolution of the display unit 110 is moved, the recognized latent image may be reduced by 50%. According to some example embodiments, the pixel movement amount of the compensation data may be determined in a range of about 0.5% and 3% of the number of simplified pixels of the resolution.

As described above, the controller 120 pixel shifts the compensation data, generates the pixel shifted compensation data, and brightness compensates the input image data by using the pixel shifted compensation data, and may form the output image data. Then, latent image energy of the display unit 110 may be dispersed by outputting the output image data.

Figure 5A:
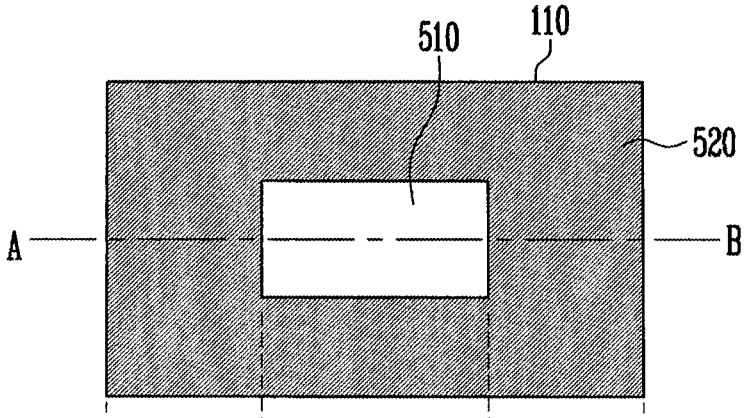
FIGS. 5A and 5B are views illustrating an example of a deterioration state of a display unit of a display device according to some example embodiments of the present invention.
Figure 5B:
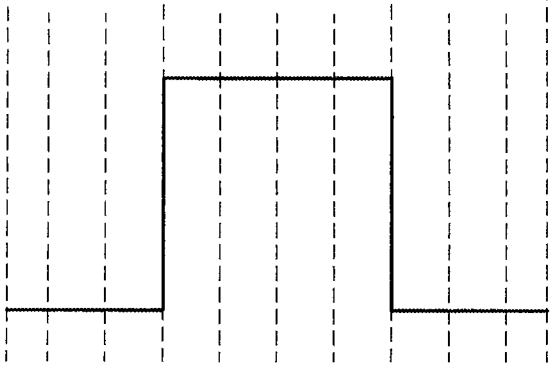

FIGS. 5A and 5B are views illustrating an example of a deterioration state of a display unit of a display device according to some example embodiments of the present invention. FIGS. 6A to 8C are views illustrating examples of a deterioration compensating method according to an embodiment of the present invention. FIGS. 9A and 9B are views illustrating examples of a compensation data pixel shifting method according to an embodiment of the present invention.

Referring to FIG. 5A, in the display unit 110 of the display device according to the embodiment of the present invention, bright image data is displayed in a first region 510 and dark image data may be displayed in a second region 520. At this time, white grayscale image data is displayed in the first region 510 and black grayscale image data may be displayed in the second region 520.

FIG. 5B is a view illustrating image brightness taken along the line A-B of FIG. 5A. At this time, when the white image data of the first region 510 is displayed for a long time, for example, for no less than 100 hours, the first region 510 of the display unit 110 may deteriorate.

Figure 6A:
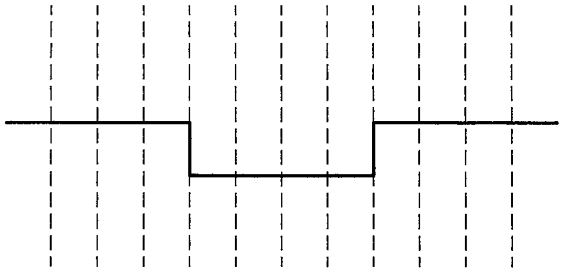
FIGS. 6A to 8C are views illustrating examples of a deterioration compensating method according to some example embodiments of the present invention.

At described above, after the first region 510 deteriorates, when the same white grayscale image data is displayed in the first region 510 and the second region 520 of the display unit 110, as illustrated in FIG. 6A, brightness of the first region 510 may be low. This is because the white grayscale image data is displayed in the first region 510 for a long time so that the pixels 117 included in the first region 510 deteriorate so that the brightness of the first region 510 deteriorates as defined in the EQUATION 1.

The controller 120 of the display device according to the embodiment of the present invention may generate the compensation data in accordance with the stress in accordance with a degree to which the brightness of the first region 510 of the display unit 110 is reduced. For example, the controller 120 may generate the compensation data as illustrated in FIG. 6B by a brightness value corresponding to the reduced brightness of FIG. 6A.

Figure 6B:
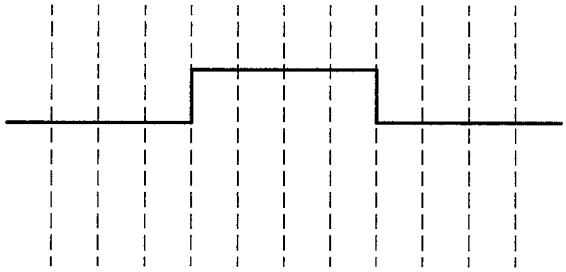
Figure 6C:
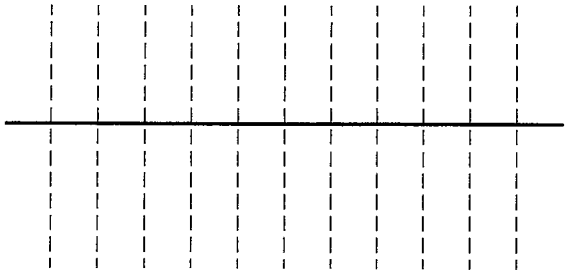

The controller 120 may compensate for the image data of FIG. 6A by the compensation data of FIG. 6B. After performing the compensation, brightness components of the pixels 117 of the display unit 110 are compensated for as illustrated in FIG. 6C.

Figure 7A:
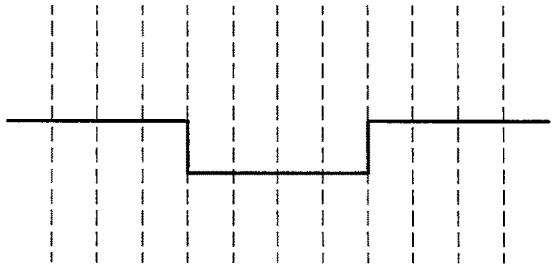
Figure 7B:
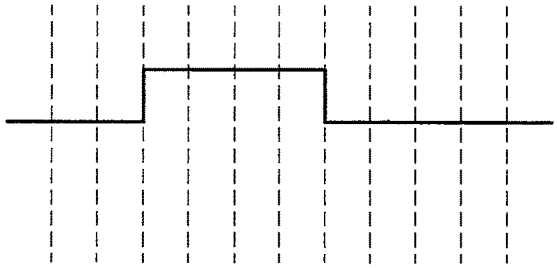

Then, after a uniform time (for example, 20 hours), in the brightness of the display unit 110, as illustrated in FIG. 7A, the brightness of the first region 510 may be low. At this time, the controller 120 may generate the compensation data in accordance with the stress in accordance with the degree to which the brightness of the first region 510 of the display unit 110 is reduced. For example, the controller 120 may generate the compensation data by a brightness value corresponding to the reduced brightness of FIG. 7A. At this time, the controller 120 pixel shifts the generated compensation data to compensate for the generated compensation data. For example, the controller 120 pixel shifts the compensation data by one pixel to the left as illustrated in FIG. 7B to generate the pixel shifted compensation data.

Figure 7C:
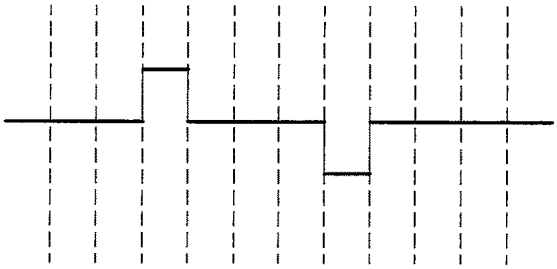

Then, the controller 120 may compensate for the image data of FIG. 7A by the pixel shifted compensation data. When the compensation is performed, the brightness components of the pixels 117 of the display unit 110 are as illustrated in FIG. 7C. That is, when the compensation is performed by using the compensation data that is pixel shifted by one pixel to the left as illustrated in FIG. 7B, as illustrated in FIG. 7C, among the pixels 117 of the display unit 110, brightness of a partial region of the first region 510 (for example, the rightmost region of the first region 510) is low and brightness of a peripheral region of the first region 510 (for example, the leftmost region closest to the first region 510) is high.

Figure 8A:
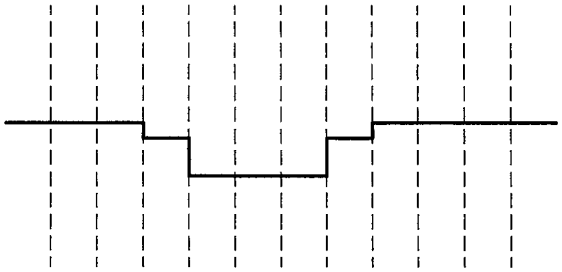
Figure 9A:
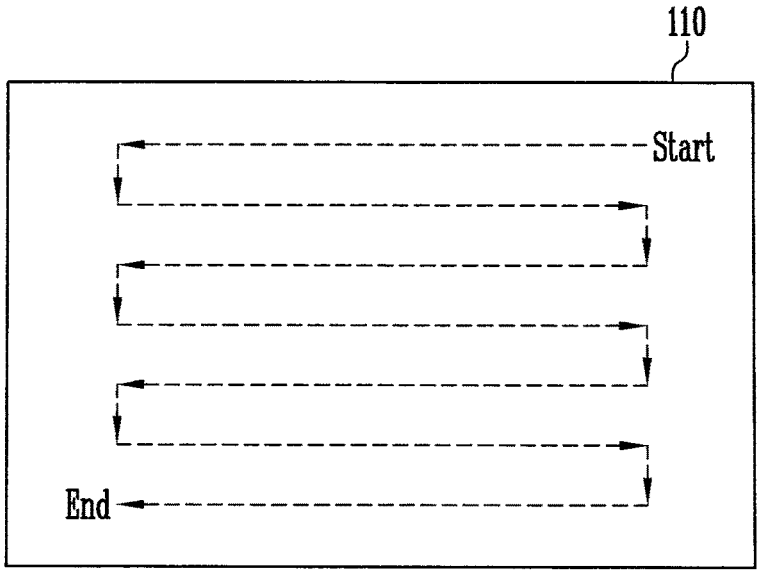
FIGS. 9A and 9B are views illustrating examples of a compensation data pixel shifting method according to some example embodiments of the present invention.
Figure 9B:
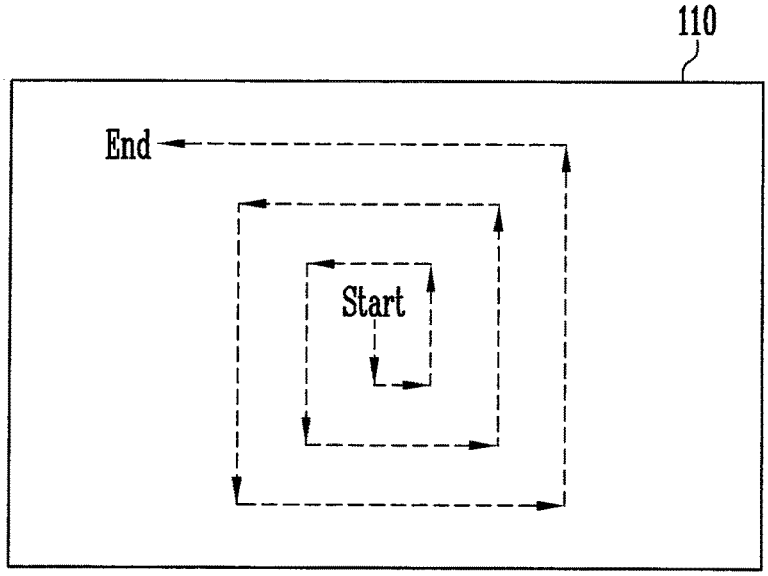

Then, after the compensation is performed as illustrated in FIG. 7C, with the lapse of a uniform time (for example, 20 hours), the brightness components of the first region 510 and the peripheral region of the first region 510 of the display unit 110 may be low as illustrated in FIG. 8A. In comparison with FIG. 7A, in FIG. 8A, it is noted that the latent image energy is dispersed in accordance with deterioration of the pixels 117 when the compensation data is pixel shifted. That is, in comparison with FIG. 7A, it is noted that a region with low brightness is narrower in FIG. 8A.

At this time, the controller 120 may generate the compensation data in accordance with the stress in accordance with a degree to which the brightness components of the first region 510 and the peripheral region of the first region 510 of the display unit 110 are reduced. For example, the controller 120 may generate the compensation data by a brightness value corresponding to the reduced brightness of FIG. 8A. At this time, the controller 120 may pixel shift the generated compensation data to compensate for the generated compensation data. For example, the controller 120 pixel shifts the compensation data by one pixel to the left as illustrated in FIG. 8B to generate the pixel shifted compensation data.

Figure 8B:
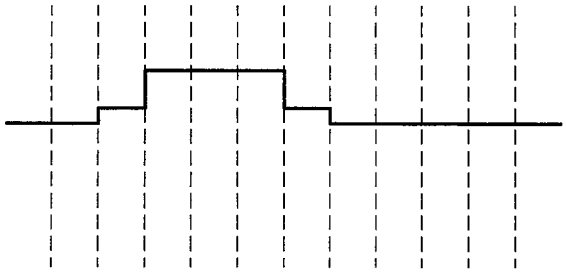

Then, the controller 120 may compensate for the image data of FIG. 8A by the pixel shifted compensation data of FIG. 8B. When the compensation is performed as described above, as illustrated in FIG. 8C, the brightness components of the pixels 117 of the display unit 110 are as illustrated in FIG. 8C.

Figure 8C:
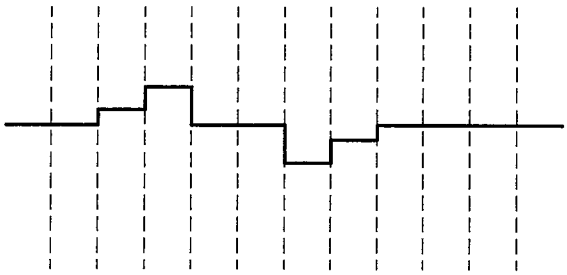

On the other hand, in a method of compensating for the image data by using the pixel shifted compensation data illustrated in FIGS. 6A to 8C, with the lapse of about 20 hours after the compensation illustrated in FIGS. 6A to 6C, compensation is performed by using the pixel shifted compensation data illustrated in FIGS. 7A to 7C and then, with the lapse of about 20 hours, compensation is performed by using the pixel shifted compensation data illustrated in FIGS. 8A to 8C. However, operation of performing compensation by using the pixel shifted compensation data may be performed in a short period. For example, the controller 120 pixel shifts the compensation data by one pixel per one minute to compensate for deteriorated pixels. In this case, because the compensation is performed in a state in which deterioration of the pixels is negligible, large distortion illustrated in FIGS. 7C and 8C may not be generated. Because the compensation operation is performed in a state in which the latent image energy is sufficiently dispersed as illustrated in FIGS. 7A and 8A, recognizable distortion is negligible.

On the other hand, the pixel shifting operation of the compensation data may be performed by the method illustrated in FIGS. 9A and 9B.

That is, the pixel shifting operation of the compensation data may be performed in X and Y axes directions of the display unit 110. For example, as illustrated in FIG. 9A, the pixel shifting operation of the compensation data is performed by one pixel from a right upper end of the display unit 110 to the left and, when the pixel shifting is completed to a left upper end of the display unit 110, after the pixel shifting operation is performed by one pixel downward, the pixel shifting operation may be performed by one pixel to the right of the display unit 110.

When the pixel shifting is completed to the right of a second row of the display unit 110, after the pixel shifting operation is performed by one pixel downward again, the pixel shifting operation may be performed by one pixel to the left of the display unit 110. The pixel shifting operation may continue to a left lower end (or a right lower end) of the display unit 110. Then, after the pixel shifting operation is performed to the left lower end (or the right lower end) of the display unit 110, the pixel shifting operation of the compensation data may be performed in a reverse direction.

Referring to FIG. 9B, the compensation data may be pixel shifted away from the center of the display unit 110 in a clockwise direction (or a counterclockwise direction) so that pixels move downward by one pixel, to the right by one pixel, and upward by two pixels one by one from the center of the display unit 110. When the pixel shifting is performed to the outermost part of the display unit 110, the compensation data may be pixel shifted toward the center of the display unit 110.

FIGS. 9A and 9B illustrate only an embodiment. The pixel shifting method of the compensation data may vary.

The electronic or electric devices and/or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the example embodiments of the present invention.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and their equivalents.

What is claimed is:

1. A display device comprising:

a controller configured to:

generate compensation data by accumulating image data; and generate the image data by applying the compensation data to input data received from an external source; and a display unit comprising a plurality of pixels configured to display an image according to the image data, wherein the controller generates the image data while pixel shifting the compensation data by a predetermined pixel movement amount, wherein the controller is configured to pixel shift the compensation data by the predetermined pixel movement amount at a predetermined speed to generate the compensation data that is pixel shifted.

2. The display device of claim 1, wherein the controller is configured to calculate a stress value according to a current flowing through a pixel from among the pixels and a duration time of the image data.

3. The display device of claim 1, wherein the controller comprises:

a stress converter configured to calculate a stress value based on the image data output from each of the pixels of the display unit and to generate the compensation data according to the stress value;

a pixel shifter configured to pixel shift the compensation data by a predetermined pixel movement amount and to generate pixel shifted compensation data; and a compensator configured to compensate for the image data according to the pixel shifted compensation data.

4. The display device of claim 3, wherein the controller further comprises a memory configured to store at least one of the stress value, the compensation data, or the pixel shifted compensation data.

5. The display device of claim 1, wherein the controller is configured to pixel shift the compensation data by one pixel from a center of the display unit away from the center of the display unit to generate the image data.

6. The display device of claim 1, wherein the controller is configured to pixel shift the compensation data by one pixel from a right upper end of the display unit to a left lower end of the display unit to generate the image data.

7. The display device of claim 1, wherein the controller is configured to determine the predetermined pixel movement amount in a range of 0.5% and 3% of a number of simplified pixels of the display unit.

8. A method of driving a display device, the method comprising:

generating compensation data by accumulating image data; and generating the image data by applying the compensation data to input data received from an external source, wherein the generating of the image data comprises generating the image data while pixel shifting the compensation data by a predetermined pixel movement amount, wherein the generating of the image data further comprises pixel shifting the compensation data by the predetermined pixel movement amount at a predetermined speed to generate pixel shifted compensation data.

9. The method of claim 8, wherein the generating of the compensation data further comprises calculating a stress value according to a current flowing through a pixel from among a plurality of pixels and a duration time of the image data.

10. The method of claim 8, wherein the generating of the compensation data comprises:

calculating a stress value according to the image data output from each pixel of a display unit; and generating compensation data according to the stress value, and wherein the generating of the image data comprises:

pixel shifting the compensation data by a predetermined pixel movement amount to generate pixel shifted compensation data; and compensating for the image data according to the pixel shifted compensation data.

11. The method of claim 10, further comprising storing at least one of the stress value, the compensation data, or the pixel shifted compensation data in a memory.

12. The method of claim 8, wherein the generating of the image data comprises pixel shifting the compensation data by one pixel from a center of a display unit away from the center of the display unit to generate the image data.

13. The method of claim 8, wherein the generating of the image data comprises pixel shifting the compensation data by one pixel from a right upper end of a display unit to a left lower end of the display unit to generate the image data.

14. The method of claim 8, wherein the generating of the image data further comprises determining the predetermined pixel movement amount in a range of 0.5% and 3% of a number of simplified pixels of a display unit.

* * * * *